US005651690A

United States Patent [19]

Klas et al.

[11] Patent Number: 5,651,690

[45] Date of Patent: Jul. 29, 1997

[54] ELECTRICAL CONNECTOR ADAPTER

[75] Inventors: Daniel E. Klas, Black Mountain; Walter H. Wersching, Shelby; Vang Hang, Valdese, all of N.C.

[73] Assignee: Hubbell Incorporated, Orange, Conn.

[21] Appl. No.: 520,762

[22] Filed: Aug. 30, 1995

[51] Int. Cl.[6] ..... H01R 13/627

[52] U.S. Cl. ..... 439/352; 439/76.1; 439/638

[58] Field of Search ..... 439/352, 353, 439/354, 344, 676, 638, 357, 358, 76.1

[56] References Cited

U.S. PATENT DOCUMENTS

| | | | |
|---|---|---|---|
| 4,241,974 | 12/1980 | Hardesty | 439/352 |
| 4,295,702 | 10/1981 | Snyder | 439/352 |
| 4,392,701 | 7/1983 | Weidler | 439/638 |
| 5,295,869 | 3/1994 | Siemon et al. | 439/76.1 |
| 5,308,260 | 5/1994 | Johnston et al. | 439/352 |
| 5,385,488 | 1/1995 | Clark | 439/571 |

FOREIGN PATENT DOCUMENTS 2092839 8/1982 United Kingdom .

*Primary Examiner*—Khiem Nguyen
*Assistant Examiner*—Yong Ki Kim
*Attorney, Agent, or Firm*—Jerry M. Presson; Mark S. Bicks

[57] ABSTRACT

An adapter for coupling electrical connectors has a housing having first and second connections on first and second opposite ends of the housing. A set of electrical contacts extends in each connection. A first connector can be coupled to the first connection and can electrically engage its electrical contacts. A circuit is mounted in the housing for electrically connecting the contacts. A latch is attached to the first connection for releasably securing the first connector to the first connection. A release is coupled to the latch and is accessible for operation at the second end of the housing for unlatching the first connection from the first connector.

28 Claims, 4 Drawing Sheets

ELECTRICAL CONNECTOR ADAPTER

FIELD OF THE INVENTION

The present invention relates to adapters for electrically and mechanically coupling two or more electrical connectors. More particularly, the present invention relates to an adapter having a modular plug with a latch for securing the plug in an external modular Jack port at one end of the adapter and having a release mechanism for the latch accessible and operable on the opposite end of the adapter for unlatching the plug and the adapter from the external modular jack port.

BACKGROUND OF THE INVENTION

Modular plugs and Jacks are often used to connect electrical circuits, particularly for communication and computer equipment. Adapters are used to facilitate the connection of these modular plugs and jacks to complete the circuit, as well as to facilitate the connection of auxiliary equipment. For example, two plugs can be connected for an extension of a telephone line from a telephone to a wall Jack. An additional connection port may also be necessary for connecting an auxiliary instrument, such as a telephone answering machine, to the telephone line and for locating the auxiliary instrument adjacent the telephone.

In this manner, adapters are used as splitting adapters or as bridging adapters. The construction of the adapter must be convertible for use as a splitting or as a bridging adapter. Further, the design should enable easy adaptation to the specific wiring requirements of the particular application and the particular modular plugs and jacks employed. The structure should enable identification of the individual wires by suitable colors and/or numbers.

To ensure a positive connection of the modular plugs to the modular jacks, the plugs and jacks are secured by latches. These latches must be operable from a convenient and accessible end of the adapter. Thus, the modular plug latch on the inaccessible end of the adapter should be accessible to facilitate connection and disconnection of the adapter to the modular Jack or connector.

Conventional adapters, such as that disclosed in U.S. Pat. No. 4,241,974 to Hardesty, have release mechanisms accessible and operable only from a side of the adapter. That construction limits the stacking of the adapters vertically or horizontally.

SUMMARY OF THE INVENTION

An object of the present invention is to provide an adapter for coupling electrical connectors having a latch attached to the adapter housing for releasably securing the adapter to a first connector at one adapter housing end and having a release for operation at the opposite end of the adapter housing for unlatching the adapter housing from the first connector.

Another object of the present invention is to provide an adapter which is easily adaptable to different wiring specifications, is simple and inexpensive to manufacture, simple to use and is of rugged construction.

Yet another object of the present invention is to provide adapters for coupling electrical connectors having latches for releasably securing the adapters to first connectors at back ends of the adapters and a release operable by reciprocal movement at the front ends of the adapters to facilitate horizontal and vertical stacking of the adapters.

A further object of the present invention is to provide an adapter for connecting electrical connectors which can be easily employed as a splitting adapter or a bridging adapter.

The foregoing objects are basically obtained by an adapter for coupling electrical connectors, comprising a housing having first and second connection means on first and second opposite ends of the housing, respectively, for connecting first and second connectors. A first set of electrical contacts is in the first connection means. A second set of electrical contacts extends in the second connection means. Circuit means are mounted in the housing for electrically connecting respective contacts of the first and second sets. Latch means is attached to the housing for releasably securing the first connection means to the first connector. Release means is coupled to the latch means, is mounted on the housing and is accessible for operation at the second end of the housing for unlatching the first connection means from the first connector.

By forming the adapter in this manner, the adapter can be simply and quickly unlatched from the first connector by operating the release means from the end of the adapter opposite the latch. Since the sides of the adapter need not be accessible, plural adapters can be stacked horizontally and vertically without interfering with access to the release means.

The arrangement of the contacts in the connection means and their connection by the circuit means facilitates adaptation of the adapter for the desired wiring between the various connectors coupled to the respective connection means. The arrangement of the contacts within the housing and the use of the circuit means enables the contacts to be properly provided with indicia to facilitate identification of the appropriate connections. Additionally, this arrangement of the adapter facilitates manufacture, reduces costs, simplifies operation and provides a rugged structure.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 2:
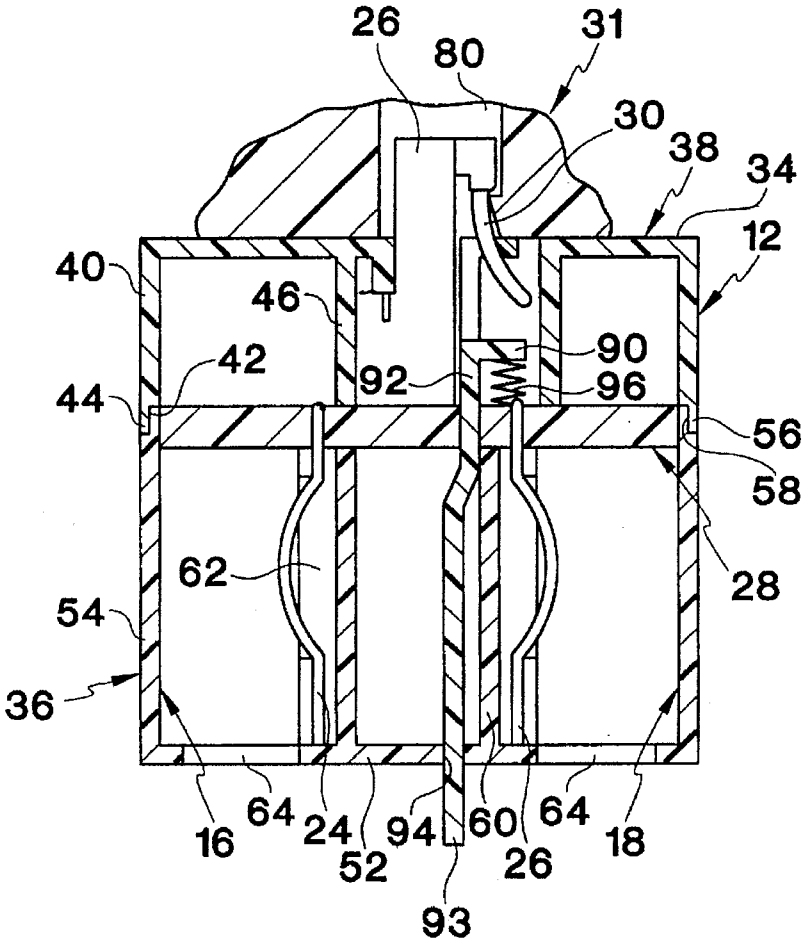
FIG. 2 is a partial side elevational view in cross section of the adapter of FIG. 1 coupled to an external modular jack port.
Figure 1:
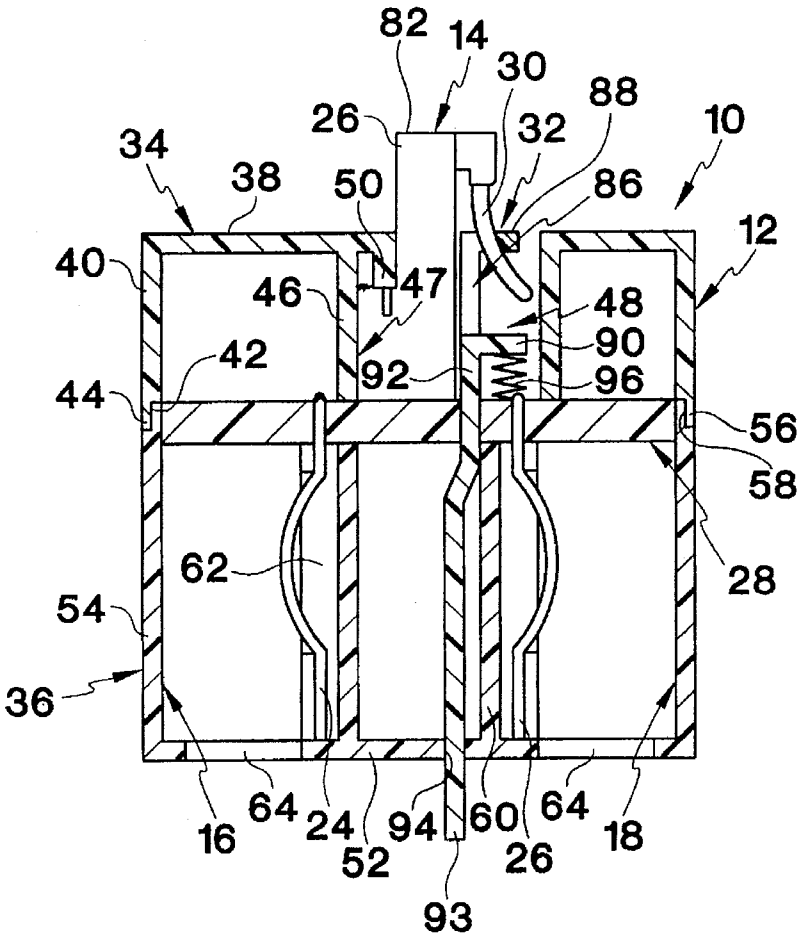
FIG. 1 is a side elevational view in cross section of an adapter according to a first embodiment of the present invention.
Figure 3:
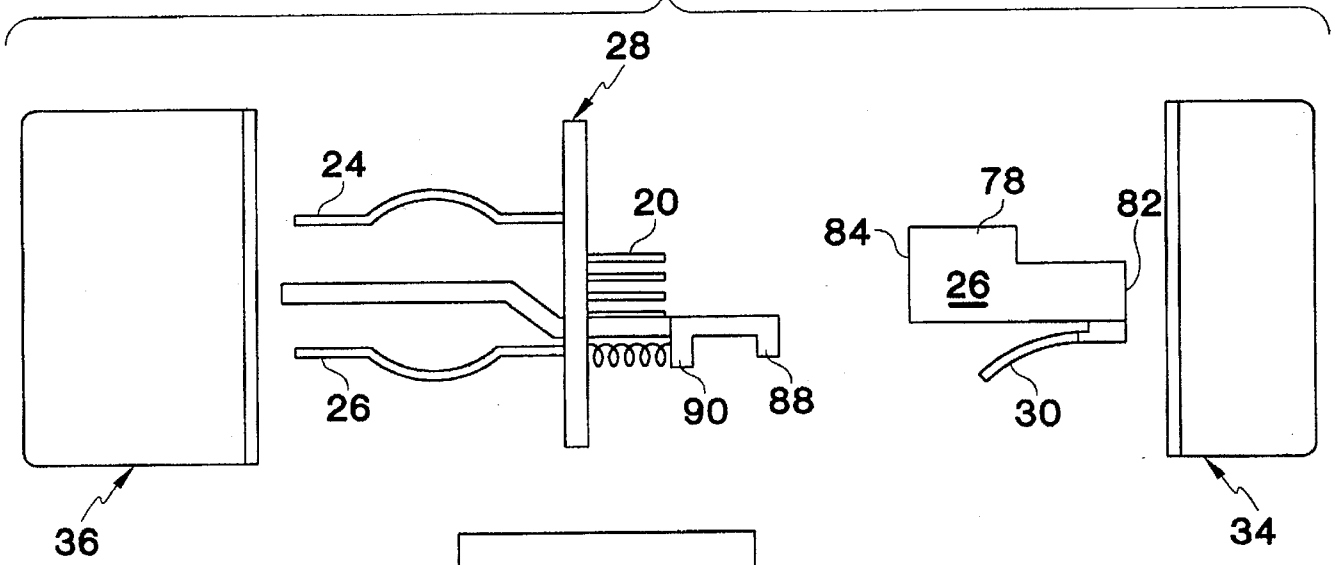
FIG. 3 is an exploded, side elevational view of the adapter of FIG. 1.

Referring initially to FIGS. 1–3, adapter 10 comprises a housing 12 having connections 14, 16 and 18. Three sets of electrical contacts 20, 24 and 26 extend in connections 14, 16 and 18, respectively. Connection 14 comprises a modular plug 26 received within a port of connection 14, and is electrically connected to contacts 20. Connections 16 and 18 are configured as connection ports. Similarly constructed, conventional modular plugs can be inserted within and secured within connection ports 16 and 18 to make electrical contact with contacts 24 and 26, respectively. A circuit 28 is mounted in housing 12 for electrically connecting the respective contacts 20, 22 and 24.

A latch 30 is attached to modular plug 26, and thereby to the housing, and releasably secures adapter 10 to first connector or external modular jack port 31. A release member 32 engages latch 30. Release member 32 is accessible on the end of housing 12 opposite modular Jack 31 for unlatching the modular plug and the remainder of the adapter from the first connector.

Housing 12 is formed by a back cover 34 and a front cover 36. Each cover is formed as a unitary piece of molded plastic. The two covers are attached according to conventional practice at their adjacent ends. Back cover 34 includes an end member 38 and a skirt member 40 which are generally rectangular in configuration. Skirt member 40 extends from the periphery of end member 38. The distal end of skirt member 30 is formed with an inner recess 42 to define an outer flange 44.

Back cover 34 has an inner, tubular shaped wall 46 extending inwardly from an opening in end member 38. Inner wall 46 is substantially coaxial with skirt member 40. The inner wall defines a plug chamber 47 and a release chamber 48 which is a contiguous extension of the plug chamber. End member 38 also has an abutment 50 extending into plug chamber 47 on the side thereof remote from release chamber 48.

Front cover 36 comprises an end member 52 and a skirt member 54 extending from the periphery of the end member. The end member and the skirt member are generally rectangular, conforming in shape to the corresponding members of back cover 34. The distal end of skirt member 34 has an outer recess 56 providing an inner flange 58. When covers 34 and 38 are joined to form housing 20, inner flange 58 is received within inner recess 42 and outer flange 44 is received within outer recess 56. After engagement of the two covers, they are secured together in a conventional manner, for example, by adhesive or ultrasonic welding.

Within skirt member 54, front cover 36 has axially extending inner walls 60. Inner walls 60, with skirt member 54, define second and third connection ports 16 and 18. The second and third connection ports are mirror images of one another. Extending laterally from inner walls 60 and into connection ports 16 and 18 are contact guides 62. The configuration of the inner walls and of the contact guides defining the connection ports 16 and 18 are conventional, and thus, are not described in detail. For example, the connection ports and contacts can be formed as modular Jack ports similar to those disclosed in U.S. Pat. No. 5,399,107 to Gentry et al and in U.S. Pat. No. 5,431,586 to Klas et al, the subject matter of each patent being incorporated herein by reference. Suitable openings 64 permit connectors to be inserted and mounted within connection port 16 and 18. Contact guides 62 receive and support contacts 24 and 26 in connection ports 16 and 18, respectively.

Figure 4:
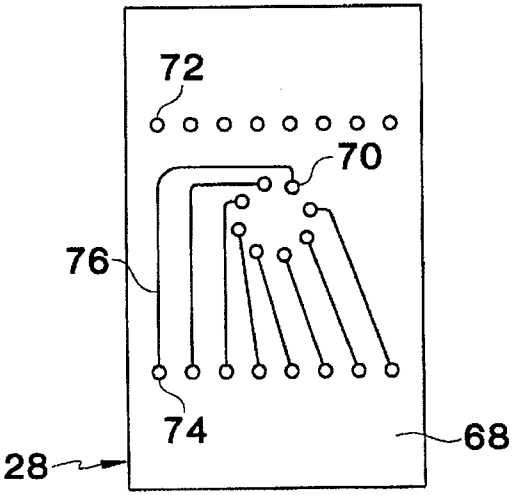
FIG. 4 is a top plan view of a circuit board for the adapter of FIG. 1.
Figure 7:
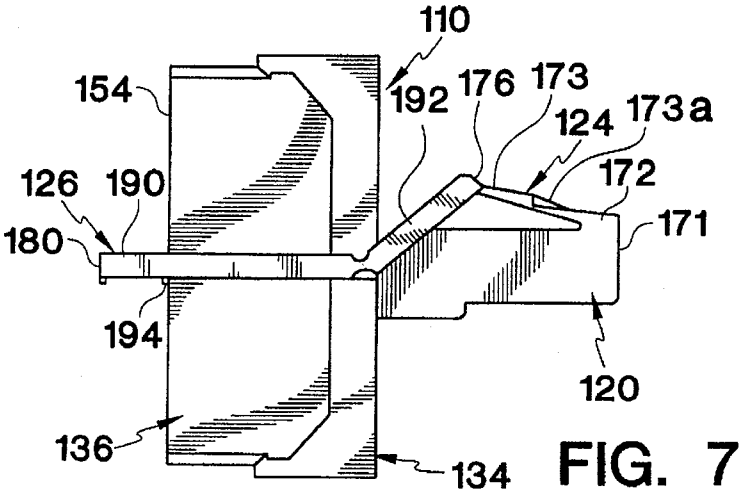
FIG. 7 is a side elevational view of the adapter of FIG. 5 in a latching position.

Circuit 28 is a printed circuit board 68 to which contacts 20, 24 and 26 are secured. As illustrated in FIG. 4, circuit board 68 has a plurality of central, plated holes or bores 70 arranged along a circular path. Plated holes or bores 72 and 74 are arrangement along linear paths on opposite sides of central holes 70. Printed conductive traces or paths 76 extend between the respective holes to electrically connect them. In FIG. 4, paths 76 connect respective plated holes 70 to respective plated holes 74. The conductive traces connecting plated holes 72 to plated holes 70 are located in a mirror image arrangement on the opposite side of the circuit board from that illustrated in FIG. 4. Contacts 20 are mounted in plated holes 70, while contacts 24 and 26 are mounted in the respective plated holes 72 and 74 such that contacts 20 are connected to contacts 24 and 26 by conductive traces 76.

Circuit board 68 is affixed within housing 12 adjacent the Joint between back cover 34 and front cover 36. The periphery of the circuit board can be secured within the housing by suitable conventional means such as ultrasonic welding or adhesive.

Modular plug 26 comprises contact receptacles for receiving contacts 20. The outer configuration of modular plug 26 includes a step 78 that conforms to and mates with abutment 50. When fully inserted within connection port 14, modular plug 26 is placed such that step 78 engages and abuts abutment 50 to inhibit inadvertent withdrawal of modular plug 26 from plug chamber 47. The modular plug is mounted in back cover 34 prior to their assembly with circuit 28 and front cover 36, as graphically illustrated in FIG. 3.

Adapter latch 30 comprises a resilient catch extending from the side of modular plug 26 opposite step 78. Latch 30 extends laterally from the plug for releaseably mating with recess 80 in external modular jack port 31. Latch 30 extends from outer end 82 of modular plug 26 at an acute angle laterally outwardly, but in the axial direction of the plug inner end 84. Plug inner end 84 has the contact receptacles for receiving contacts 20. The curved configuration of latch or catch 30 and its angular orientation provide a camming effect to facilitate release of latch 30. Latch 30 and external modular Jack port 31 have conventional mating abutments.

Release member 32 comprises an opening 86 receiving plug latch 30. Release 32 is formed as a one piece, unitary molded part of plastic material. Opening 86 is defined adjacent one end of the release member between an abutment member 88 and a laterally extending flange 90. Abutment member 88 and flange 90 extend laterally from longitudinal member 92. Longitudinal member 92 extends axially through release chamber 48 adjacent modular plug 26, and is laterally spaced from inner wall 46 by a distance corresponding to the corresponding width of modular plug 26. A suitable opening is formed in printed circuit board 68, from that illustrated in FIG. 4, to permit longitudinal member 92 to pass through the circuit board.

Release member 32 is formed with laterally offset handle or operator extension 93 that is parallel, but slightly laterally offset, relative to longitudinal member 92. Extension 93 of release member 32 extends through the housing between inner walls 60 of front cover 36 and out an opening 94 in front cover end member 52. The release member extends through the housing between connection ports 16 and 14. The extension of release member 32 exteriorly out of the front cover permits access to the release member from the front end of the adapter housing and operational movement of the release member within the lateral periphery of the adapter.

A spring 96 is located within the adapter housing portion surrounded by back cover 34 and circuit board 68. The spring is located between an adjacent surface of circuit board 68 and a facing surface of flange 90 to bias the flange and latch opening 86 away from circuit board 68 toward the position illustrated in FIG. 1. However, the spring allows the release member to move, with the flange moving in the direction of the circuit board against the bias of the spring. Release member 32 is actuated by being pulled in a direction at the exposed end of extension 93 away from front cover end member 52.

Release member 32 is movable between a first position, illustrated in FIG. 1, in which latch 30 extends through opening 86 to latch modular plug 26 and the remainder of the adapter to external modular jack port 31, and a second position disengaging the latch modular plug 26 from recess 80 in external modular jack port 31. In this second, release position, the release member is pulled in a downward direction, as illustrated in FIG. 1, to compress spring 96. Movement of the release member against the bias of spring 96 causes abutment member 86 to engage and travel along latch 30 such that the abutment member cams the resilient catch inwardly against its inherent bias until the abutment on latch 30 is removed from the corresponding abutment in recess 80. When latch 30 is released from recess 80, latch 30 is in its second or release position. In that second position, the modular plug can be removed from the external modular jack port.

Referring now to the second embodiment of the present invention illustrated in FIGS. 5–8, adapter 110 comprises a housing 112. Housing 112, in the position illustrated in FIGS. 5 and 6, has a first connection 114 on its lower end surface and second and third connections 116 and 118 on its upper end surface. Connection 114 comprises a modular plug 120 fixed to housing 112, which plug is graphically illustrated in FIGS. 5–8. The modular plug is connected to contacts extending from and out the bottom surface of housing 112. Connections 116 and 118 are configured as connection ports. Suitable contacts are formed and mounted in the mirror image connection ports 116 and 118 in a conventional manner. In view of the conventional orientation and construction of these contacts and ports, the contacts are not illustrated. Relative to the structure of the connection ports and the mounting of the contacts therein, reference is again made to U.S. Pat. No. 5,431,586 to Klas et al. and to U.S. Pat. No. 5,399,107 to Gentry et al. The contacts are omitted from the drawings for clarification. A circuit 122 is mounted in the housing for electrically connecting the respective contacts of connections 114, 116 and 118.

A latch 124 is attached to modular plug 120, and thereby to housing 112, for releasably securing adapter 110 or modular plug 120 in an external modular Jack port 128 of the type disclosed in U.S. Pat. Nos. 5,431,586 and 5,399,107. A release member 126 is coupled to adapter housing 112, engages latch 124 and is accessible from the end of housing 112 opposite that of modular plug 120 for unlatching modular plug 120 and the remainder of the adapter from external modular jack 128.

Housing 112 comprises a lower member 134 and an upper member 136. Lower member 134 comprises a rectangular base 138. Resilient latch members 140 extend upwardly from the opposite longitudinal ends of base 134. The latch members have inwardly extending tangs or projections 142 extending laterally inwardly from the latch members. The contacts of connection 114 extend through base 138. On the lateral sides of base 138, adjacent connection 114, guide channels 144 and 146 are formed. The two guide channels formed in the base as mirror images of one another. Each guide channel has a straight section 148 and an angled section 150. One side of the angled section is colinearly arranged with the corresponding side of the straight section. The opposite side of the angled section extends at a generally obtuse angle to its corresponding side of the straight section.

Upper member 136 is configured to have connection ports 116 and 118 formed of similar construction in mirror image to one another. The upper member is generally in the form of a rectangular parallelpiped. The opposite outer ends of the upper member have ledges 152. Ledges 152 engage projections 142 on base member latch members 140 to attach the upper and lower members. The upper side 154 and the lateral sides 156 and 158 are provided with guide channels, 160, 162 and 164, respectively. Guide channels 162 and 164 are parallel and directly opposite one another on upper member 136, and are connected by guide channel 160.

Circuit 122 is formed by a printed circuit board 166. The printed circuit board has plated through holes 168. The plated through holes receive portions of the electrical contacts. Circuit traces (not shown) are printed on the circuit board to connect the various plated through holes, and therefore, the respective contacts of the connection ports 114, 116 and 118.

Circuit board 166 is located between and trapped between lower member 134 and upper member 136. Lower member 134 is provided with a recessed upper surface, i.e., that surface facing upper member 136, and is configured to receive the circuit board 166. This recessed upper surface of lower member 134 positively locates and retains the circuit board in its proper position within the housing and enables a portion of the lower surface of upper member 136 to directly contact the upper surface of base 138 to provide a more stable housing 112.

Modular plug 120 has a connection end 170 configured in a conventional manner for receiving the contacts of connection 114 and an insertion end 171 for receipt in external modular Jack port 128. Latch 124 is in the form of a resilient catch extending from the insertion end of the modular plug opposite connection end 170. The latch extends laterally outwardly from the remainder of the modular plug and releaseably engages a catch **128*a* in external modular Jack port 128. Latch 124 comprises a hinge end 172 adjacent plug end 171, an extension 173 coupled to hinge end 171 and a tapered abutment 173*a*. Extension 173 extends at an acute angle from the latch hinge end, away from the modular plug body, in the general direction of connection end 170**.

Release member 126 is formed by a rectangular frame 174. Frame 174 has four sides 176, 178, 180 and 182. The four sides define an opening 184 between the sides for receiving extension 173 of latch 124. Side 176 forms an abutment member for engaging extension 173. Side 180 provides the handle or operation member, along with portions of sides 178 and 182.

Sides 178 and 182 have integral or living hinges 186 and 188, respectively. The hinges separate each of sides 178 and 182 into a sliding section 190 and an angled section 192. Sliding section 190 of side 178 is slidably received in guide channel 162 in upper member 136 and in straight section 148 of guide channel 144 in lower member 134. Sliding section 190 of side 182 is in guide channel 164 in upper section 136 and in the straight portion of guide channel 146 on the side of base 134 aligned with upper member side 158. Angled portions 192 of sides 178 and 182 are pivotable about hinges 186 and 188 in angled sections 150 of guide channels 144 and 146 in lower member 134. The angled portions pivot between two anglely oriented positions which provide for latching of the modular plug and for unlatching of the modular plug relative to the external modular jack port.

A Stop bar 194 extends perpendicularly between frame sides 178 and 182, and extends parallel to and between side 176 and 180. However, stop bar 194 is closer to side 180 than it is to side 176. The stop bar is received within guide channel 160 and abuts the guide channel defining surface of upper member 136 when the release member is in its latching or first position illustrated in FIG. 4. The space between side 176 and stop bar 194 can be filled with an additional frame panel.

Figure 8:
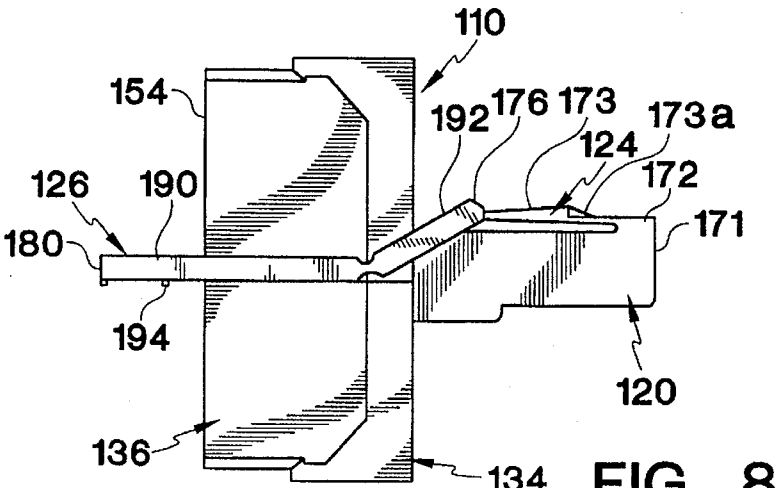
FIG. 8 is a side elevational view of the adapter of FIG. 5 in a released position.
Figure 5:
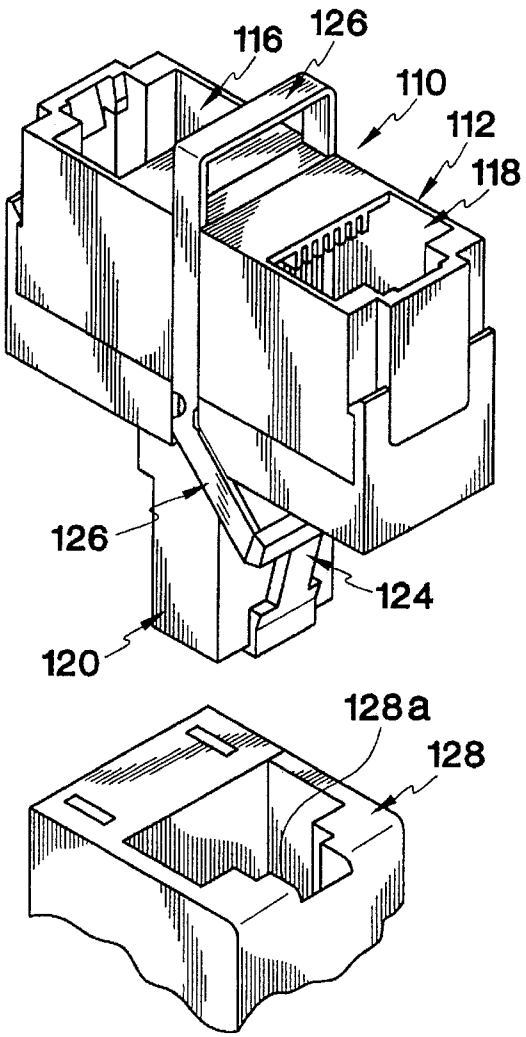
FIG. 5 is a perspective view of an adapter and external modular Jack port according to a second embodiment of the present invention.
Figure 6:
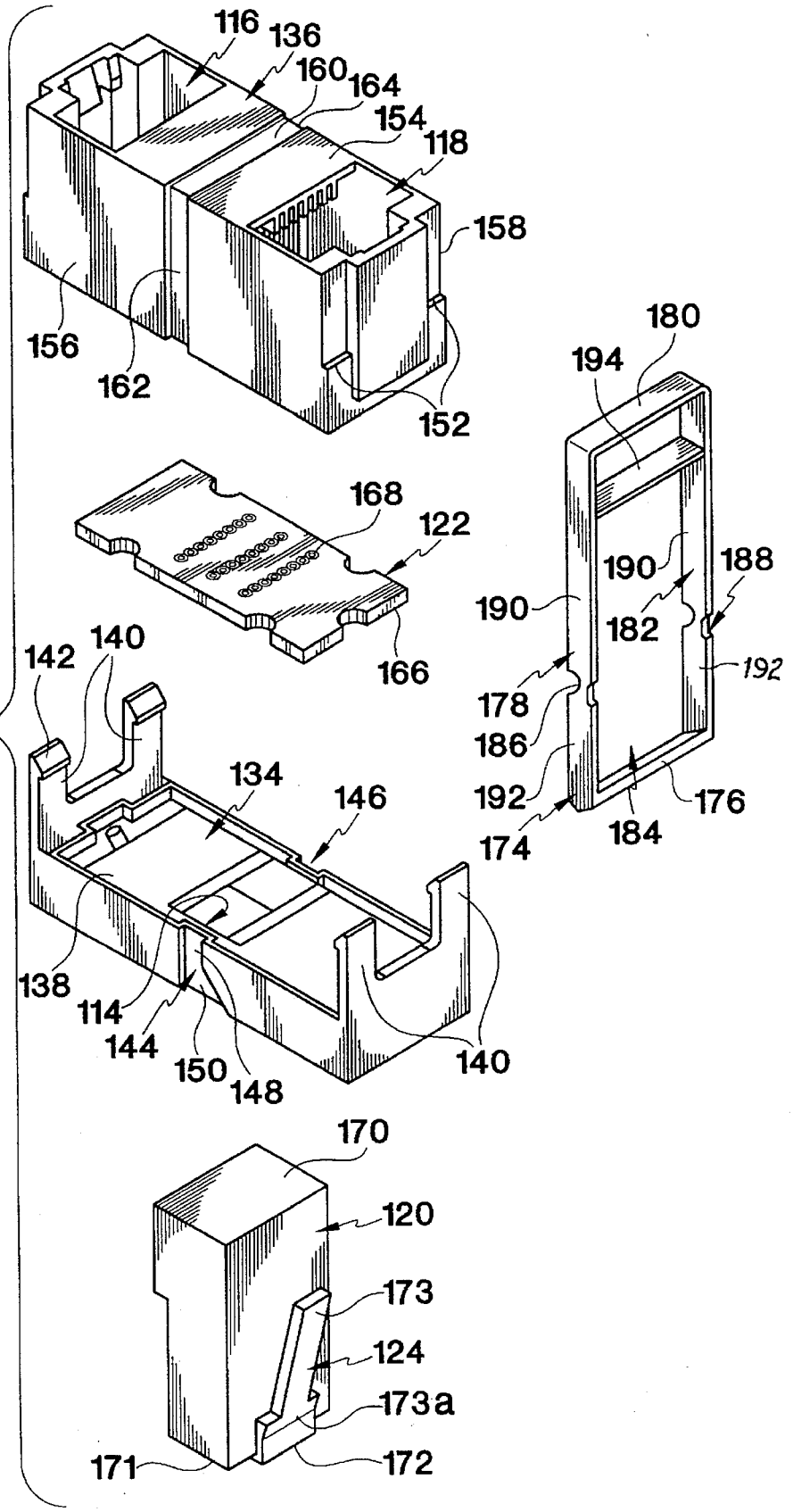
FIG. 6 is an exploded, perspective view of the adapter of FIG. 5.

To release modular plug 120 from external Jack port 128, release member 126, at side 180, is grasped by the operator and pulled in a direction away from upper side 154 of upper member 136. Pulling side 180 away from housing side pulls hinges 186 and 188 toward and into the straight portions along with the adjacent sections of angled sections 192 from the latching position illustrated in FIG. 7. Such movement tends to decrease the obtuse angle included between the sliding and angled sections of sides 178 and 182 and exerts an inward force on latch 124 as abutment side 176 travels on and cams along the upper or outward cam surface of latch extension 173. Such force pushes the latch abutment 173*a* inwardly, as illustrated in FIG. 8, as side 176 moves toward, but not beyond, the free distal end of latch 124 to release latch abutment 173*a* from external Jack port catch 128*a*, and thereby, modular plug 120 from the external modular jack port. The reverse operation can be used for latching modular plug 120 in the external modular jack. The extension of release member 126 exteriorly from housing front surface 154 permits access to the release member from the housing front end and operational movement of the release member within the lateral periphery of the adapter.

While various embodiments have been chosen to illustrate the invention, it will be understood by those skilled in the art that various changes and modifications can be made therein without departing from the scope of the invention as defined in the appended claims.

What is claimed is:

1. An adapter for coupling electrical connectors, comprising:

a housing having first and second connection means on first and second opposite ends of said housing, respectively, for connecting first and second connectors;

a first set of electrical contacts extending in said first connection means;

a second set of electrical contacts extending in said second connection means;

a circuit mounted in said housing and electrically connecting respective contacts of said first and second sets;

latch means, attached to said housing, for releasably securing said first connection means to the first connector; and a relatively rigid release member, directly coupled to said latch means, axially slidably mounted on said housing and accessible for operation at said second end of said housing for unlatching said first connection means from the first connector.

2. An adapter according to claim 1 wherein said circuit comprises a printed circuit board with printed circuit traces and first and second sets of plated holes for receiving ends of said first and second sets of electrical contacts, respectively, said circuit traces connecting respective plated holes.

3. An adapter according to claim 1 wherein said housing comprises a third connection means for receiving a third connector port with a third set of electrical contacts extending therein; and said circuit means electrically connecting said third set of contacts to respective contacts of said first and second sets.

4. An adapter according to claim 3 wherein said third connection means is on said second end of said housing adjacent said second connection means.

5. An adapter according to claim 4 wherein said release member extends between said second and third connection means.

6. An adapter according to claim 3 wherein said second and third connection means are mirror images of one another.

7. An adapter according to claim 1 wherein said latch means comprises a resilient catch extending laterally from said first connection means.

8. An adapter according to claim 7 wherein said release member is movable between a first position freeing said catch and allowing said catch to latch said first connection means to the first connector and a second position disengaging said catch from the first connector to unlatch said first connection means from said first connector.

9. An adapter according to claim 8 wherein said release member is resiliently biased toward said first position.

10. An adapter according to claim 9 wherein said release member comprises a latch opening receiving said catch in said first position.

11. An adapter according to claim 10 wherein said catch extends at an acute angle from a distal end of said first connection means; and said latch opening comprises an abutment member engaging a cam surface of said catch facing away from said first connection means.

12. An adapter according to claim 11 wherein said housing comprises a release chamber adjacent said first connection means, said release chamber receiving said catch and said abutment member;

said release member comprises a laterally extending flange in said release chamber; and a spring extends in said release chamber and abuts said flange to bias said release member toward said first position.

13. An adapter according to claim 12 wherein said circuit means comprises a circuit board; and said first connection means and said release chamber are closed at one end thereof by said circuit board, said spring abutting said circuit board opposite said flange.

14. An adapter according to claim 11 wherein said release member comprises a unitary extension extending through said housing and beyond said second end of said housing.

15. An adapter according to claim 11 wherein said release member comprises a hinge formed as a unitary portion of said release member.

16. An adapter according to claim 11 wherein said release member is formed by a rectangular frame with first, second, third and fourth sides, said first and third sides being parallel and opposite, said second and fourth sides being parallel and opposite;

said first side forms said abutment member;

said housing has first and second guide channels slidably receiving said second and fourth sides, respectively; and said third side forms gripping means.

17. An adapter according to claim 16 wherein said rectangular frame comprises a stop bar extending parallel to and spaced between said first and third sides, said stop bar engaging said second end of said housing in said first position of said release member and being spaced from said second end of said housing in said second position of said release member.

18. An adapter according to claim 1 wherein said release member extends between and is relatively rigid along an entire length between said latch means and said second end.

19. An adapter for coupling electrical connectors, comprising:

a housing having first and second connection means on first and second opposite ends of said housing, respectively, for connecting first and second connectors;

a first set of electrical contacts extending in said first connection means;

a second set of electrical contacts extending in said second connection means;

a circuit mounted in said housing and electrically connecting respective contacts of said first and second sets;

a resilient catch, attached to said housing and extending laterally from said first connection means, for releasably securing said first connection means to the first connector; and release means, coupled to said latch means, mounted on said housing and accessible for operation at said second end of said housing for unlatching said first connection means from the first connector, said release means being movable between a first position freeing said catch and allowing said catch to latch said first connection means to the first connector and a second position disengaging said catch from the first connector to unlatch said first connection means from said first connector, said release means being resiliently biased toward said first position, said release means having a latch opening receiving said catch in said first position.

20. An adapter according to claim 19 wherein said catch extends at an acute angle from a distal end of said first connection means; and said latch opening comprises an abutment member engaging a cam surface of said catch facing away from said first connection means.

21. An adapter according to claim 20 wherein said housing comprises a release chamber adjacent said first connection means, said release chamber receiving said catch and said abutment member;

said release means comprises a laterally extending flange in said release chamber; and a spring extends in said release chamber and abuts said flange to bias said release means toward said first position.

22. An adapter according to claim 21 wherein said circuit means comprises a circuit board; and said first connection means and said release chamber are closed at one end thereof by said circuit board, said spring abutting said circuit board opposite said flange.

23. An adapter according to claim 19 wherein said release means comprises a unitary extension extending through said housing and beyond said second end of said housing.

24. An adapter according to claim 19 wherein said release means comprises a hinge formed as a unitary portion of said release means.

25. An adapter according to claim 19 wherein said release means is formed by a rectangular frame with first, second, third and fourth sides, said first and third sides being parallel and opposite, said second and fourth sides being parallel and opposite;

said first side forms said abutment member;

said housing has first and second guide channels slidably receiving said second and fourth sides, respectively; and said third side forms gripping means.

26. An adapter according to claim 25 wherein said second and fourth sides have hinges separating each of said second and fourth sides into a sliding section slidably received in one of said guide channels and an angled section, angularly oriented relative to the respective sliding section, said angled sections being pivotable relative to said sliding sections at said hinges.

27. An adapter according to claim 21 wherein said hinges are reduced width sections of said second and fourth sides.

28. An adapter according to claim 27 wherein said rectangular frame comprises a stop bar extending parallel to and spaced between said first and third sides, said stop bar engaging said second end of said housing in said first position of said release means and being spaced from said second end of said housing in said second position of said release means.

* * * * *